US007211941B2

(12) United States Patent
Taniwa

(10) Patent No.: US 7,211,941 B2
(45) Date of Patent: May 1, 2007

(54) DEFLECTION YOKE AND CATHODE-RAY TUBE APPARATUS

(75) Inventor: Kenichiro Taniwa, Takatsuki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 332 days.

(21) Appl. No.: 11/046,111

(22) Filed: Jan. 28, 2005

(65) Prior Publication Data

US 2005/0168123 A1 Aug. 4, 2005

(30) Foreign Application Priority Data

Feb. 2, 2004 (JP) ..... 2004-025869

(51) Int. Cl.
*H01J 29/70* (2006.01)

(52) U.S. Cl. ..... 313/440; 313/421

(58) Field of Classification Search ..... 313/421, 313/440; 335/213

See application file for complete search history.

(56) References Cited

U.S. PATENT DOCUMENTS 5,250,876 A 10/1993 Van Mierlo et al.
6,133,333 A 10/2000 Chaudhary et al.
2003/0173913 A1 9/2003 Taniwa et al.

FOREIGN PATENT DOCUMENTS

| | | |
|---|---|---|
| JP | 61-46933 | 3/1986 |
| JP | 4-308634 | 10/1992 |
| JP | 10-88818 | 4/1998 |
| JP | 2003-119236 | 4/2003 |

*Primary Examiner*—Vip Patel
(74) *Attorney, Agent, or Firm*—Hamre, Schumann, Mueller & Larson, P.C.

(57) ABSTRACT

A deflection yoke includes a horizontal deflection coil, a vertical deflection coil, an insulating frame made of an insulating material, a deflection adjusting plate attached to an outer circumferential surface of the insulating frame, and a ferrite core covering at least a part of an outer circumference of the insulating frame. The deflection adjusting plate is fixed to the outer circumferential surface of the insulating frame, under the condition of being surrounded by a high-soft resin material with a hardness of 10 to 60. Because of this, even when the deflection adjusting plate vibrates during driving, the deflection adjusting plate does not directly bump into the insulating frame, so that the noise generated by the deflection yoke can be reduced significantly.

6 Claims, 6 Drawing Sheets

DEFLECTION YOKE AND CATHODE-RAY TUBE APPARATUS

BACKGROUND OF THE INVENTION

1. Field of the Invention

The present invention relates to a deflection yoke, which is mounted on a funnel of a cathode-ray tube, for deflecting an electron beam in a horizontal direction and a vertical direction. The present invention also relates to a cathode-ray tube apparatus with the deflection yoke mounted thereon.

2. Description of the Related Art

A schematic configuration of a conventional deflection yoke (for example, see JP4(1992)-308634A) will be described with reference to FIG. 6. In FIG. 6, a Z-axis is a tube axis of a cathode-ray tube on which a deflection yoke 100 is mounted. The cross-sectional shape of the deflection yoke 100 is substantially symmetrical with respect to the Z-axis. Therefore, FIG. 6 shows a partial cross-sectional view of the deflection yoke 100 on one side with respect to the Z-axis.

Reference numeral 11 denotes a saddle-type horizontal deflection coil, 12 denotes a vertical deflection coil wound around a ferrite core 14 in a toroidal shape, and 13 denotes an insulating frame made of resin for insulating the horizontal deflection coil 11 from the vertical deflection coil 12. Reference numeral 20 denotes a plate-shaped deflection adjusting plate made of a magnetic material, for correcting a magnetic field generated by the horizontal deflection coil 11 and the vertical deflection coil 12.

The deflection adjusting plate 20 is attached to be fixed to a predetermined position on an outer circumferential surface of the insulating frame 13 with an acetate tape 29 having a size larger than that of the deflection adjusting plate 20. At this time, one surface of the deflection adjusting plate 20 comes into direct contact with the outer circumferential surface of the insulating frame 13, and the other surface thereof is covered with the acetate tape 29. After the deflection adjusting plate 20 is attached to the outer circumferential surface of the insulating frame 13, an integrated body of the vertical deflection coil 12 and the ferrite core 14 is mounted so as to cover the insulating frame 13. Thereafter, a hot-melt adhesive 25 is injected into a space between the integrated body of the vertical deflection coil 12 and the ferrite core 14, and the insulating frame 13. The ferrite core 14 and the insulating frame 13 are integrated with each other with the hot-melt adhesive 25.

When a deflection current is supplied to the horizontal deflection coil 11 and the vertical deflection coil 12 of the deflection yoke 100, the deflection adjusting plate 20 vibrates in accordance with an alternating magnetic field generated by the horizontal deflection coil 11 and the vertical deflection coil 12.

In the conventional deflection yoke 100 shown in FIG. 6, the hot-melt adhesive 25 is of a quick drying type. Therefore, the hot-melt adhesive 25 is cured before spreading sufficiently to an entire region of the space between the ferrite core 14 and the insulating frame 13. Thus, a gap may be formed between the acetate tape 29 and the hot-melt adhesive 25. In this state, the force of binding the deflection adjusting plate 20 is relatively weak, so that the deflection adjusting plate 20 bumps into the insulating frame 13 and the hot-melt adhesive 25, both of which have a high hardness, due to the vibration of the deflection adjusting plate 20, thereby causing noise.

SUMMARY OF THE INVENTION

The present invention solves the above-mentioned problem of the conventional deflection yoke, and its object is to provide a deflection yoke and a cathode-ray tube apparatus with the generation of noise suppressed during the supply of a deflection current.

A deflection yoke of the present invention includes a horizontal deflection coil, a vertical deflection coil, an insulating frame made of an insulating material, a deflection adjusting plate attached to an outer circumferential surface of the insulating frame, and a ferrite core covering at least a part of an outer circumference of the insulating frame. The deflection adjusting plate is fixed to the outer circumferential surface of the insulating frame, under a condition of being surrounded by a high-soft resin material with a hardness of 10 to 60.

Furthermore, a cathode-ray tube apparatus of the present invention includes an envelope composed of a front panel and a funnel, an electron gun provided in a neck portion of the funnel, and a deflection yoke for deflecting an electron beam emitted from the electron gun in a horizontal direction and a vertical direction. The deflection yoke is the above-mentioned deflection yoke of the present invention.

These and other advantages of the present invention will become apparent to those skilled in the art upon reading and understanding the following detailed description with reference to the accompanying figures.

DESCRIPTION OF THE PREFERRED EMBODIMENTS

According to the present invention, the deflection adjusting plate is surrounded by a high-soft resin material with a hardness of 10 to 60. Therefore, even when the deflection adjusting plate vibrates during driving, the deflection adjusting plate does not directly bump into the insulating frame and the hot-melt adhesive. This reduces the noise generated by the deflection yoke during driving significantly.

In the above-mentioned deflection yoke of the present invention, it is preferable that a low-soft adhesive with a hardness higher than that of the high-soft resin material is provided between the ferrite core, and the insulating frame and the high-soft resin material. According to this configuration, the noise generated by the deflection yoke due to the vibration of the ferrite core, which is likely to be conspicuous mainly when a vertical deflection current with a high frequency is supplied, can be reduced significantly.

Furthermore, the above-mentioned deflection yoke of the present invention may further include an auxiliary coil apparatus composed of a core made of a metallic magnetic substance and an auxiliary coil wound around the core, and attached to the insulating frame. In this case, it is preferable that a high-soft resin material with a hardness of 10 to 60 is interposed in at least a part between the auxiliary coil apparatus and the insulating frame. By providing the auxiliary coil apparatus, a high-precision image display can be performed. Furthermore, due to the presence of the high-soft resin material between the auxiliary coil apparatus and the insulating frame, the noise generated by the bump between the auxiliary coil apparatus and the insulating frame upon the application of an alternating current to the auxiliary coil can be reduced.

Hereinafter, the present invention will be described in detail by way of specific embodiments.

Embodiment 1

Figure 1:
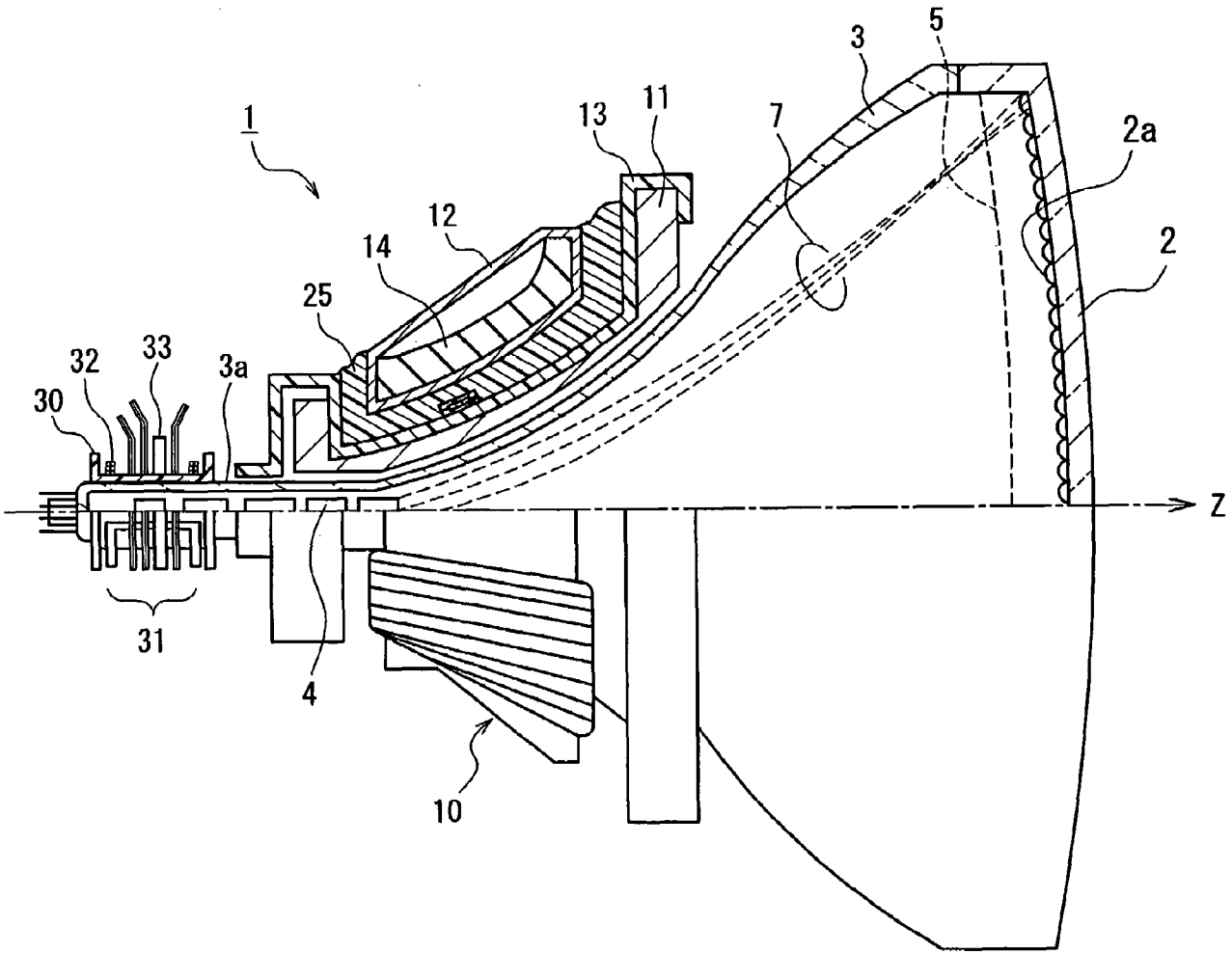
FIG. 1 is a partial cross-sectional view showing a schematic configuration of a cathode-ray tube apparatus according to one embodiment of the present invention.

FIG. 1 is a view showing a configuration of a cathode-ray tube apparatus according to Embodiment 1 of the present invention. In FIG. 1, a Z-axis corresponds to a tube axis of a cathode-ray tube. In FIG. 1, a cross-sectional view and an outer appearance view are shown on an upper side and a lower side of the Z-axis, respectively.

A cathode-ray tube (CRT) includes an envelope composed of a front panel 2 and a funnel 3, and an electron gun 4 provided in a neck portion 3*a* of the funnel 3. A cathode-ray tube apparatus 1 includes the cathode-ray tube and a deflection yoke 10 mounted on an outer circumferential surface of the funnel 3. On an inner surface of the panel 2, a phosphor screen 2*a* is formed, in which respective phosphor dots (or phosphor stripes) of blue (B), green (G), and red (R) are arranged. A shadow mask 5 is attached to an inner wall surface of the front panel 2 so as to be opposed to the phosphor screen 2*a*. The shadow mask 5 is made of a metallic plate with a number of substantially slot-shaped apertures, which are electron beam passage apertures, formed by etching, and three electron beams 7 emitted from the electron gun 4 pass through the apertures to strike predetermined phosphor dots.

Reference numeral 31 denotes a convergence and purity unit (CPU), which adjusts a static convergence and purity of electron beams at the center of a screen. The CPU 31 includes a dipole magnet ring, a quadrupole magnet ring, and a hexapole magnet ring. The respective dipole, quadrupole, and hexapole magnet rings are configured by stacking two annular magnets.

Reference numeral 30 denotes a substantially cylindrical holder for holding the CPU 31. The holder 30 is externally placed on an outer circumference of the neck portion 3*a*.

Reference numeral 32 denotes a pair of beam velocity modulation (BVM) coils provided so as to be substantially symmetrical with respect to a horizontal plane including the Z-axis with the horizontal plane interposed therebetween. Windings thereof are placed along the outer circumferential surface of the holder 30 to generate a magnetic field in a substantially vertical direction.

Reference numeral 33 denotes a magnetic substance ring for enhancing a magnetic field density of the BVM coils 32. The magnetic substance ring 33 is held by the holder 30.

Figure 2:
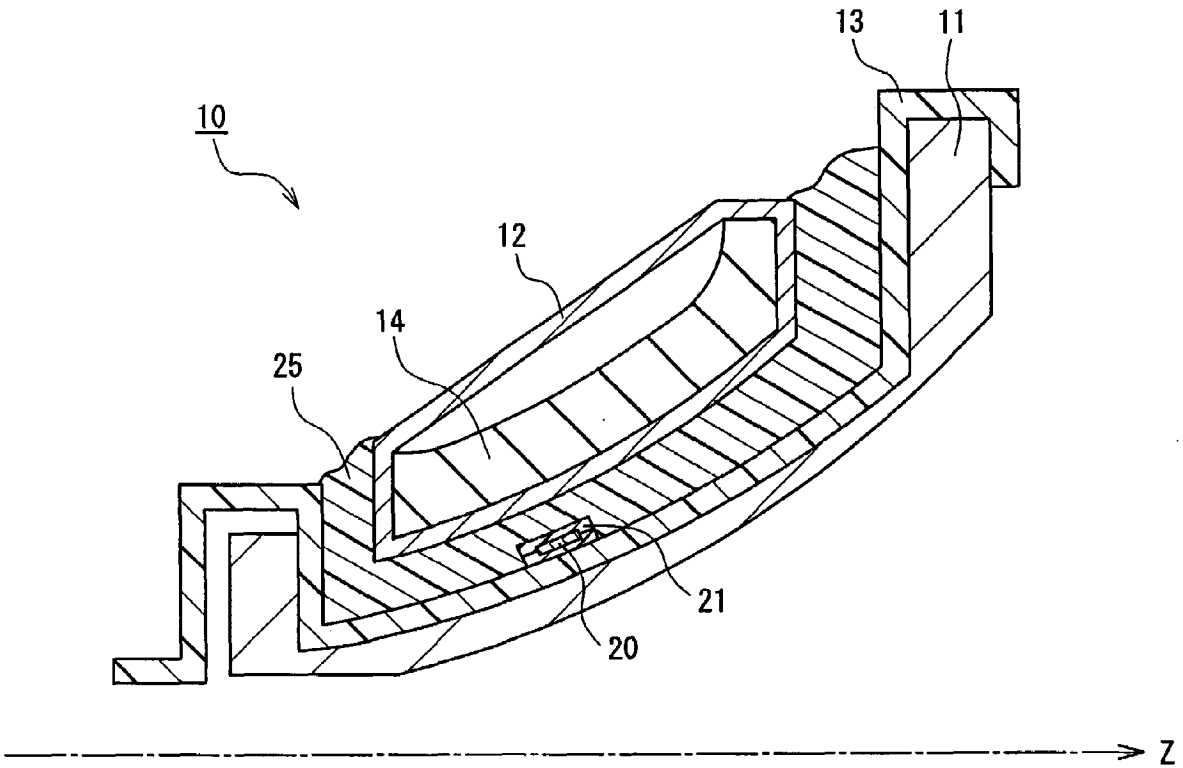
FIG. 2 is a partial cross-sectional view showing a schematic configuration of a deflection yoke according to Embodiment 1 of the present invention.

The deflection yoke 10 deflects the three electron beams 7 emitted from the electron gun 4 in horizontal and vertical directions to allow them to scan the phosphor screen 2*a*. The deflection yoke 10 of the present embodiment will be described with reference to FIG. 2. The cross-sectional shape of the deflection yoke 10 is substantially symmetrical with respect to the Z-axis. Therefore, FIG. 2 shows a partial cross-sectional view of the deflection yoke 10 on one side with respect to the Z-axis.

The deflection yoke 10 includes a saddle-type horizontal deflection coil 11, a toroidal vertical deflection coil 12, and a ferrite core 14. An insulating frame 13 made of an insulating material (e.g., resin) is provided between the horizontal deflection coil 11 and the vertical deflection coil 12. The insulating frame 13 plays the role of maintaining electrical insulation between the horizontal deflection coil 11 and the vertical deflection coil 12, as well as holding the horizontal deflection coil 11.

A deflection adjusting plate 20 in a plate shape surrounded by a high-soft resin material 21 is placed at a predetermined position on an outer circumferential surface of the insulating frame 13. The deflection adjusting plate 20 adjusts the distribution of a deflection magnetic field (in particular, a vertical deflection magnetic field) generated by the deflection yoke 10. There is no particular limit on the material for the deflection adjusting plate 20. For example, a high-permeability material (a metal plate, a sintered body of metal powder, etc.) with a permeability of 500 or more (preferably, 1000 or more) can be used. Herein, the permeability refers to an A.C. initial permeability ($\mu_{iac}$) measured at a frequency of 100 kHz and a current of 0.5 mA. The deflection adjusting plate 20 is made of, for example, a silicon steel plate, a permalloy, or the like. The hardness (Asker hardness, Type C) of the high-soft resin material 21 is 10 to 60.

There is no particular limit on a method for attaching the deflection adjusting plate 20 surrounded by the high-soft resin material 21 to the insulating frame 13. The deflection adjusting plate 20 can be fixed, for example, using an adhesive (or sticky) tape such as an acetate tape in the same way as in the conventional example. Furthermore, in the case where the high-soft resin material 21 itself has stickiness, it may be attached to the insulating frame 13 using its sticking force.

After the deflection adjusting plate 20 surrounded by the high-soft resin material 21 is attached to the outer circumferential surface of the insulating frame 13, a hot-melt adhesive 25 is injected into a space between an integrated body of the vertical deflection coil 12 and the ferrite core 14, and the insulating frame 13 in the same way as in the conventional example. The ferrite core 14 and the insulating frame 13 are integrated with each other with the hot-melt adhesive 25.

The function of the deflection yoke 10 of Embodiment 1 thus configured will be described.

In the same way as in the conventional example, even in the present embodiment, the ferrite core 14 and the insulating frame 13 are fixed to each other by injecting the hot-melt adhesive 25 therebetween. The hot-melt adhesive 25 cannot completely fill the space between the ferrite core 14 and the insulating frame 13 due to its quick drying property, and a gap may be formed between the hot-melt adhesive 25 and the high-soft resin material 21 surrounding the deflection adjusting plate 20. Thus, when a deflection current is supplied to the horizontal deflection coil 11 and the vertical deflection coil 12 of the deflection yoke 10, the deflection adjusting plate 20 vibrates in the gap in accordance with an alternating magnetic field generated by the horizontal deflection coil 11 and the vertical deflection coil 12. However, the periphery of the deflection adjusting plate 20 is covered with the high-soft resin material 21, so that the deflection adjusting plate 20 does not directly bump into the insulating frame 13 and the hot-melt adhesive 25, both of which have a high hardness. This reduces the noise generated by the deflection yoke 10 during driving significantly.

When the hardness (Asker hardness, Type C) of the high-soft resin material 21 is less than 10, the high-soft resin material 21 is too soft, which makes it difficult for the high-soft resin material 21 to hold the deflection adjusting plate 20 at a predetermined position of the insulating frame 13. Consequently, a desired magnetic field adjusting effect by the deflection adjusting plate 20 cannot be obtained, whereby an image is degraded. Furthermore, when the hardness of the high-soft resin material 21 is larger than 60, the high-soft resin material 21 is too hard. Therefore, when the deflection adjusting plate 20 vibrates, the noise caused by the bump of the high-soft resin material 21 into the insulating frame 13 and the hot-melt adhesive 25 is increased.

In Embodiment 1, the space between the ferrite core 14 and the insulating frame 13 is filled with the hot-melt adhesive 25. However, the present invention is not limited thereto. For example, the hot-melt adhesive 25 may be provided to only the vicinity of each opening on a small diameter side and a large diameter side in the space between the ferrite core 14 and the insulating frame 13.

Embodiment 2

Figure 3:
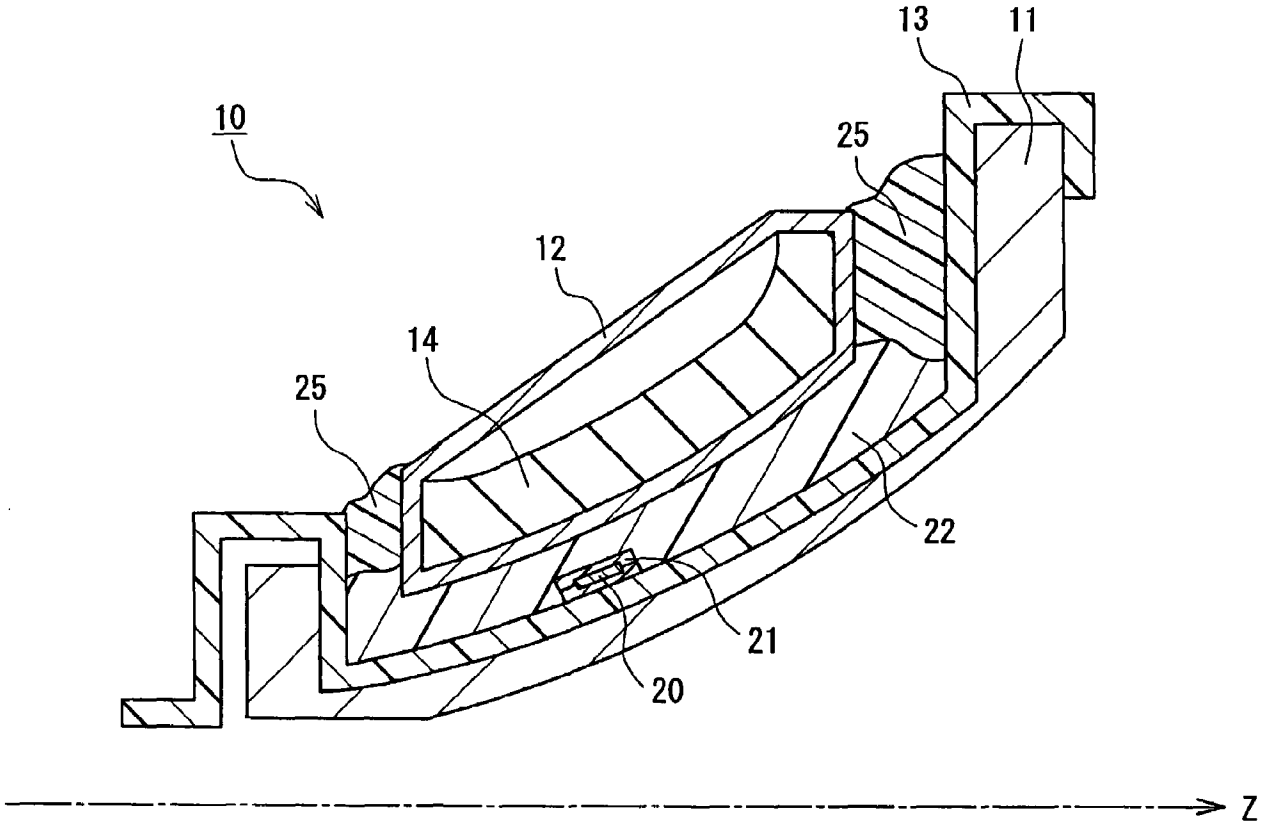
FIG. 3 is a partial cross-sectional view showing a schematic configuration of a deflection yoke according to Embodiment 2 of the present invention.

FIG. 3 shows a partial cross-sectional view of a deflection yoke according to Embodiment 2. The same elements as those of the deflection yoke 10 according to Embodiment 1 shown in FIG. 2 are denoted with the same reference numerals as those therein, and the description thereof will be omitted here.

Embodiment 2 is different from Embodiment 1, in that the space between the integrated body of the vertical deflection coil 12 and the ferrite core 14, and the insulating frame 13 is filled with a low-soft adhesive 22 with a hardness higher than that of the high-soft resin material 21. The hot-melt adhesive 25 is provided to the vicinity of each opening on a small diameter side and a large diameter side between the ferrite core 14 and the insulating frame 13, whereby the ferrite core 14 and the insulating frame 13 are integrated with each other.

As the low-soft adhesive 22, for example, an epoxy resin adhesive, a silicon adhesive, resin containing a silyl group (e.g., "Super X8008" produced by Cemedine Co., Ltd.) can be used.

The function of the deflection yoke 10 of Embodiment 2 thus configured will be described.

It takes a longer time for the low-soft adhesive 22 to be cured, compared with the hot-melt adhesive 25. Thus, during assembly of the deflection yoke 10, the low-soft adhesive 22 is likely to spread sufficiently to an entire region of the space between the ferrite core 14 and the insulating frame 13. Furthermore, the hardness of the low-soft adhesive 22 after being cured is lower than that of the hot-melt adhesive 25.

In the case where the frequency of a deflection current supplied to the deflection yoke 10 is high, the vibration of the ferrite core 14 as well as that of the deflection adjusting plate 20 cannot be ignored. In the conventional deflection yoke 100, when the ferrite core 14 vibrates, the ferrite core 14 and the peripheral members thereof bump into each other to generate noise. However, according to the present embodiment, the low-soft adhesive 22 between the ferrite core 14 and the insulating frame 13 is provided at a filling density higher than that of the hot-melt adhesive 25, and has a low hardness. Therefore, the action of absorbing the vibration of the ferrite core 14 by the low-soft adhesive 22 is much larger than that by the hot-melt adhesive 25. Thus, during driving, the noise generated by the deflection yoke 10 due to the vibration of the ferrite core 14 can be reduced significantly.

Furthermore, the high-soft resin material 21 surrounding the deflection adjusting plate 20 comes into contact with the low-soft adhesive 22. Thus, compared with Embodiment 1 in which the high-soft resin material 21 comes into contact with the hot-melt adhesive 25 with a hardness higher than that of the low-soft adhesive 22, the action of absorbing the vibration of the deflection adjusting plate 20 is increased. Therefore, during driving, the noise generated by the deflection yoke 10 due to the vibration of the deflection adjusting plate 20 can be reduced further.

In the present embodiment, the low-soft adhesive 22 and/or the hot-melt adhesive 25 do not need to fill the entire space between the ferrite core 14 and the insulating frame 13, and a gap that is not filled with the adhesive may be present in the space.

Embodiment 3

Figure 4:
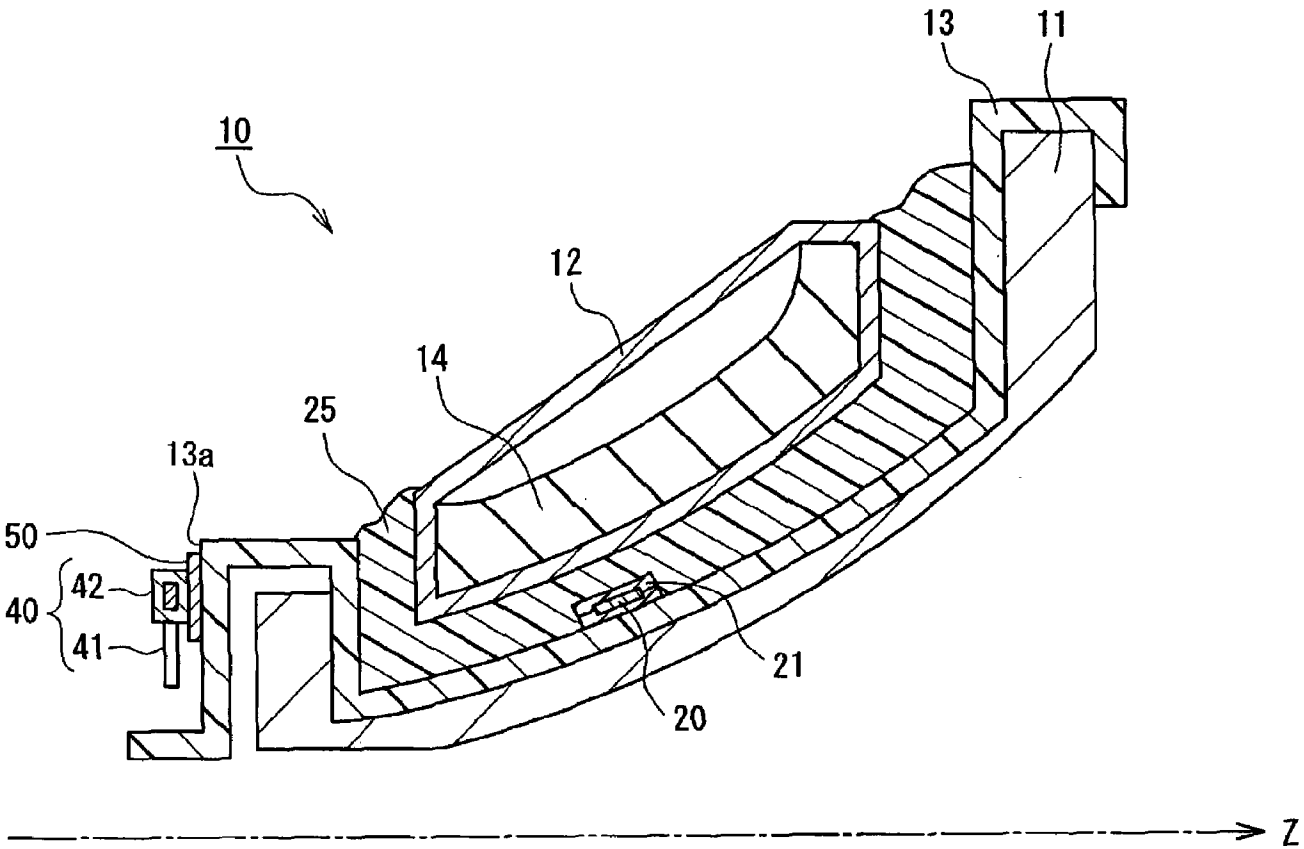
FIG. 4 is a partial cross-sectional view showing a schematic configuration of a deflection yoke according to Embodiment 3 of the present invention.

FIG. 4 shows a partial cross-sectional view of a deflection yoke according to Embodiment 3. The same elements as those of the deflection yoke 10 according to Embodiment 1 shown in FIG. 2 are denoted with the same reference numerals as those therein, and the description thereof will be omitted here.

Figure 5:
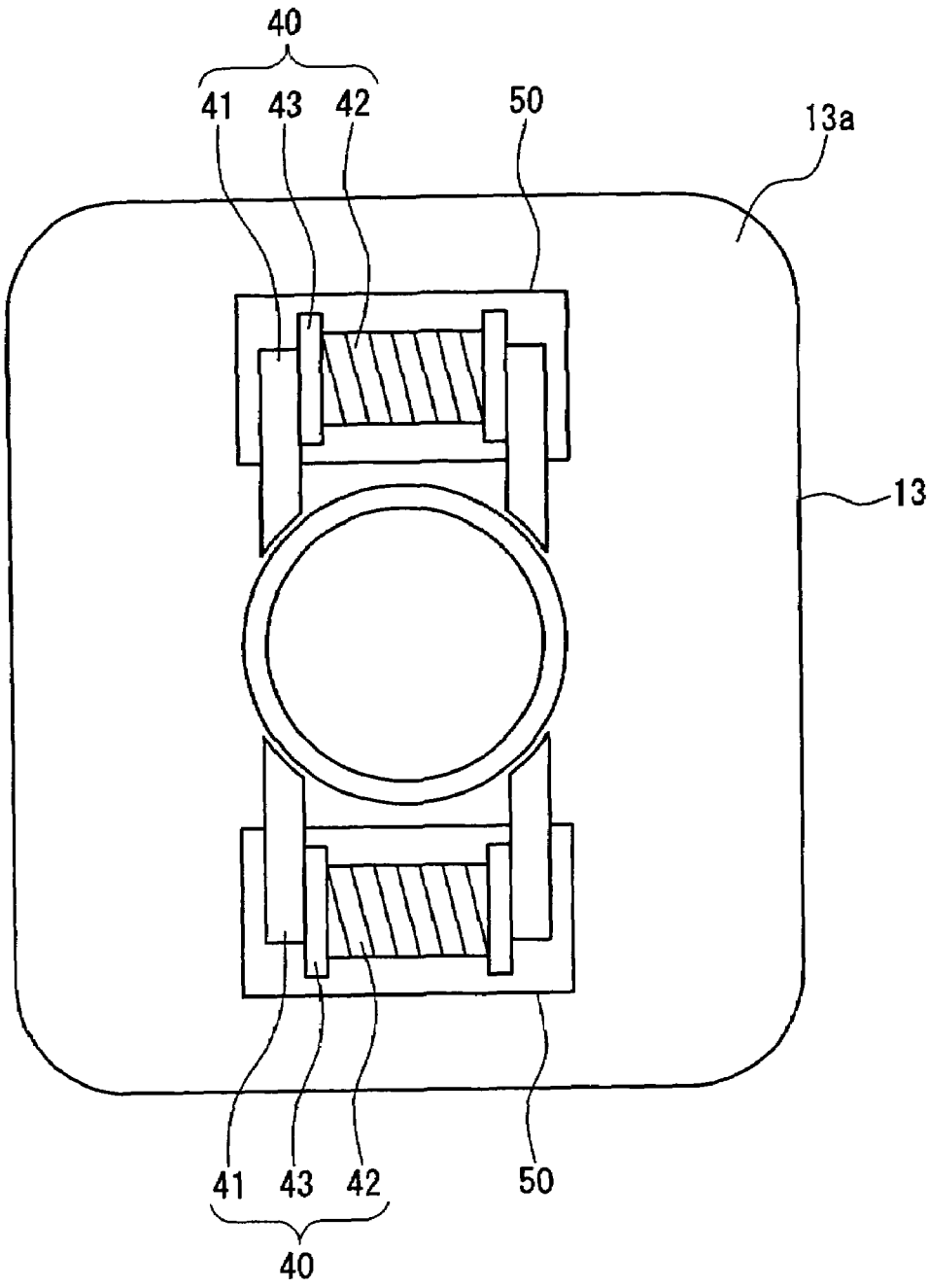
FIG. 5 is a front view showing an attachment state of a pair of auxiliary coil apparatuses in the deflection yoke according to Embodiment 3 of the present invention.

Embodiment 3 is different from Embodiment 1, in that a pair of auxiliary coil apparatuses 40 are attached to a rear surface plate 13*a* of the insulating frame 13, positioned on the CPU 31 side with respect to the horizontal deflection coil 11 in the Z-axis direction, so as to be symmetrical with respect to the Z-axis. FIG. 5 shows a state in which the pair of auxiliary coil apparatuses 40 attached to the rear surface plate 13*a* of the insulating frame 13 are seen from the CPU 31 side.

Each auxiliary coil apparatus 40 is composed of a U-shaped core 41 made of a metallic magnetic substance, a bobbin 43 in a substantially hollow cylindrical shape placed on the core 41, and an auxiliary coil 42 wound around an external circumferential surface of the bobbin 43. The auxiliary coil 42 is connected in series or in parallel to the vertical deflection coil 12, and generates a magnetic field synchronized with a vertical deflection magnetic field to correct the coma aberration in a beam spot shape on the phosphor screen 2*a* and the convergence of the three electron beams 7.

The auxiliary coil apparatus 40 is attached to the insulating frame 13, for example, by fitting or engaging the core 41 with respect to an attachment mechanism such as a groove, a hook, or the like formed in the insulating frame 13. An adhesive may be provided between the auxiliary coil apparatus 40 and the attachment mechanism.

In the present embodiment, a high-soft resin material 50 with a hardness (Asker hardness, type C) of 10 to 60 is interposed between the auxiliary coil apparatus 40 and the insulating frame 13. The function obtained by this configuration will be described.

When a current synchronized with the vertical deflection coil 12 is supplied to the auxiliary coil 42, the core 41 vibrates in accordance with an alternating magnetic field generated by the auxiliary coil 42. In the conventional deflection yoke in which the high-soft resin material 50 is not interposed, there is a problem that the vibration of the core 41 causes the auxiliary coil apparatus 40 and the insulating frame 13 to bump into each other to generate noise. According to the present invention, the high-soft resin material 50 is interposed between the auxiliary coil apparatus 40 and the insulating frame 13. Therefore, the auxiliary coil apparatus 40 and the insulating frame 13 do not directly bump into each other, which can suppress the generation of noise during driving.

It is preferable that the hardness of the high-soft resin material 50 is 10 to 60. When the hardness of the high-soft resin material 50 is less than 10, the high-soft resin material 50 is too soft, which makes it difficult for the high-soft resin material 50 to maintain a desired shape for a long period of time. Furthermore, when the hardness of the high-soft resin material 50 is larger than 60, the high-soft resin material 50 is too hard. Therefore, the effect of suppressing noise when the core 41 vibrates is decreased.

There is no particular limit on the material for the high-soft resin material 50, as long as it has a hardness of 10 to 60, and the same material as the high-soft resin material 21 surrounding the deflection adjusting plate 20 can be used.

The high-soft resin material 50 only need be provided at least in a portion that is effective for reducing noise generated when the core 41 vibrates, in a region where the auxiliary coil apparatus 40 is opposed to the insulating frame 13.

In the above description, the case where the core 41 has a U-shape has been shown. However, the shape of the core is not limited thereto, and the core 41 may be in a I-shape, an E-shape, or the like. Furthermore, the pair of auxiliary coil apparatuses 40 only need be placed so as to sandwich the Z-axis (i.e., three electron beams 7), and can be attached on a vertical axis, a horizontal axis, or the like in accordance with a desired effect.

EXAMPLES

An example will be described in which the present invention is applied to a deflection yoke for a color cathode-ray tube apparatus with an diagonal size of 29 inches and an aspect ratio of a screen of 4:3.

Example 1

As shown in FIG. 2, the insulating frame 13 made of resin with the saddle-type horizontal deflection coil 11 wound on an inner circumferential surface, and the ferrite core 14 with the toroidal vertical deflection coil 12 wound were prepared. As the deflection adjusting plate 20, a silicon steel plate (length: 30 mm, width: 5 mm, thickness: 0.5 mm) was used, which was deformed into a curved surface so as to be matched with the radius of curvature of the outer circumferential surface of the insulating frame 13 to which the deflection adjusting plate 20 is to be attached. As the high-soft resin material 21, "ThreeSealer U0" (Asker hardness (Type C): 25±5 degrees in terms of a catalog value) produced by ThreeBond Co., Ltd., containing butyl rubber as a main component was cut into two sheets each having a size larger than the deflection adjusting plate 20.

One sheet-shaped high-soft resin material 21 was attached to a predetermined position on the outer circumferential surface of the insulating frame 13, using its stickiness. Then, the deflection adjusting plate 20 was attached to the high-soft resin material 21, using the stickiness of the high-soft resin material 21. Furthermore, the other sheet-shaped high-soft resin material 21 was attached to the deflection adjusting plate 20 attached to the high-soft resin material 21. Thus, the deflection adjusting plate 20 was fixed to the outer circumferential surface of the insulating frame 13, under the condition that the entire circumferential surface of the deflection adjusting plate 20 was covered with the high-soft resin material 21.

After the ferrite core 14 was mounted so as to cover a part of the outer circumference of the insulating frame 13, a hot-melt adhesive produced by Hirodine Co., Ltd. was injected to be cured in the space between the ferrite core 14 and the insulating frame 13. Thus, the deflection yoke 10 shown in FIG. 2 was obtained, in which the ferrite core 14 and the insulating frame 13 were fixed to each other with the hot-melt adhesive 25 provided therebetween.

The deflection yoke 10 was placed in an anechoic room, and a vertical deflection current of 50 Hz was supplied to the vertical deflection coil 12. At this time, the noise generated by the deflection yoke 10 was measured with a microphone set at a position away from the deflection yoke 10 by 110 mm. Consequently, the noise level was 33.6 dB.

Example 2

An epoxy resin adhesive was applied to an inner circumferential surface of the ferrite core 14 as the low-soft adhesive 22. Thereafter, the ferrite core 14 was mounted on the insulating frame 13. Thus, the space between the ferrite core 14, and the insulating frame 13 and the high-soft resin material 21 was almost filled with the low-soft adhesive 22. Thereafter, the hot-melt adhesive 25 produced by Hirodine Co., Ltd. was provided to the vicinity of each opening on a small diameter side and a large diameter side between the ferrite core 14 and the insulating frame 13. The deflection yoke 10 shown in FIG. 3 was obtained in the same way as in Example 1 except for the above.

The noise generated when the deflection yoke 10 was driven was measured in the same way as in Example 1 except that the frequency of a vertical deflection current supplied to the vertical deflection coil 12 was set to be 100 Hz. Consequently, the noise level was 32.6 dB.

Comparative Example 1

Figure 6:
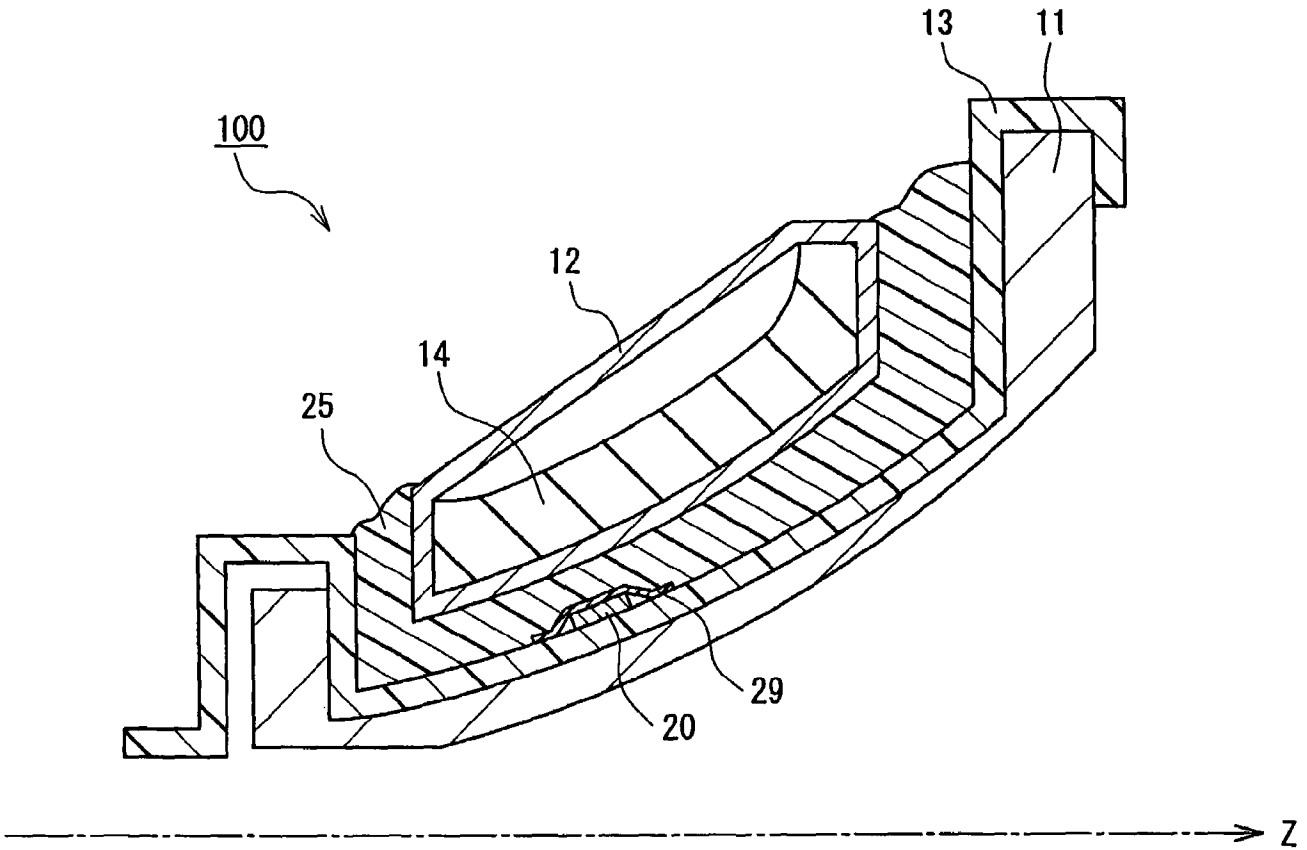
FIG. 6 PRIOR ART
FIG. 6 is a partial cross-sectional view showing a schematic configuration of a conventional deflection yoke.

One surface of the deflection adjusting plate 20 was brought into contact with the outer circumferential surface of the insulating frame 13, and an acetate tape larger than the other surface of the deflection adjusting plate 20 was attached to the other surface, whereby the deflection adjusting plate 20 was fixed to the outer circumferential surface of the insulating frame 13. The deflection yoke 100 shown in FIG. 6 was obtained in the same way as in Example 1 except for the above.

The noise generated when the deflection yoke 10 was driven was measured in the same way as in Example 1, with the frequency of a vertical deflection current supplied to the vertical deflection coil 12 varied in two ways (i.e., 50 Hz and 100 Hz). Consequently, the noise level was 36 dB when the vertical deflection frequency was 50 Hz, and 37 dB when the vertical deflection frequency was 100 Hz.

When the vertical deflection frequency was 50 Hz, noise mainly caused by the vibration of the deflection adjusting plate 20 was generated in the deflection yoke 100 of Comparative Example 1. In contrast, in the deflection yoke 10 of Example 1, the noise level was reduced to 34 dB or less, which is considered to be the standard of low noise.

Furthermore, when the vertical deflection frequency was 100 Hz, in the deflection yoke 100 of Comparative Example 1, noise caused by the vibration of the ferrite core 14 as well as the vibration of the deflection adjusting plate 20 was generated. In contrast, in the deflection yoke 10 of Example 2, the noise level was reduced to 34 dB or less that was considered to be the standard of low noise.

The present invention is not limited to the above-mentioned embodiments and examples. For example, the shape and attachment position of the deflection adjusting plate 20 can be appropriately changed so as to adjust a deflection magnetic field. The vertical deflection coil 12 may be a saddle type, instead of a toroidal type. The present invention also is applicable to a cathode-ray tube apparatus of a monochromic display, instead of a color cathode-ray tube apparatus.

The applicable field of the deflection yoke and the cathode-ray tube apparatus with the deflection yoke mounted thereon of the present invention is not particularly limited. For example, the present invention can be used widely in a television, a computer display, or the like.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A deflection yoke comprising a horizontal deflection coil, a vertical deflection coil, an insulating frame made of an insulating material, a deflection adjusting plate attached to an outer circumferential surface of the insulating frame, and a ferrite core covering at least a part of an outer circumference of the insulating frame, wherein the deflection adjusting plate is fixed to the outer circumferential surface of the insulating frame, under a condition of being surrounded by a high-soft resin material with a hardness of 10 to 60.

2. The deflection yoke according to claim 1, wherein a low-soft adhesive with a hardness higher than that of the high-soft resin material is provided between the ferrite core, and the insulating frame and the high-soft resin material.

3. The deflection yoke according to claim 1, further comprising an auxiliary coil apparatus composed of a core made of a metallic magnetic substance and an auxiliary coil wound around the core, and attached to the insulating frame, wherein a high-soft resin material with a hardness of 10 to 60 is interposed in at least a part between the auxiliary coil apparatus and the insulating frame.

4. A cathode-ray tube apparatus comprising an envelope composed of a front panel and a funnel, an electron gun provided in a neck portion of the funnel, and a deflection yoke for deflecting an electron beam emitted from the electron gun in a horizontal direction and a vertical direction, wherein the deflection yoke is the deflection yoke of claim 1.

5. A cathode-ray tube apparatus comprising an envelope composed of a front panel and a funnel, an electron gun provided in a neck portion of the funnel, and a deflection yoke for deflecting an electron beam emitted from the electron gun in a horizontal direction and a vertical direction, wherein the deflection yoke is the deflection yoke of claim 2.

6. A cathode-ray tube apparatus comprising an envelope composed of a front panel and a funnel, an electron gun provided in a neck portion of the funnel, and a deflection yoke for deflecting an electron beam emitted from the electron gun in a horizontal direction and a vertical direction, wherein the deflection yoke is the deflection yoke of claim 3.

* * * * *